US005863262A

United States Patent [19]

Donofrio

[11] Patent Number: 5,863,262

[45] Date of Patent: Jan. 26, 1999

[54] GOLF PUTTER HEAD PUTTING DEVICE

[75] Inventor: Matt Donofrio, Paterson, N.J.

[73] Assignee: Patent Holding Corp., Paterson, N.J.

[21] Appl. No.: 869,241

[22] Filed: Jun. 4, 1997

[51] Int. Cl.[6] ..... A63B 53/04

[52] U.S. Cl. ..... 473/330; 473/340

[58] Field of Search ..... 473/330, 340, 473/313, 291, 251, 341

[56] References Cited

U.S. PATENT DOCUMENTS

| | | | |
|---|---|---|---|
| 656,099 | 8/1900 | Dunn | 473/330 |
| 1,467,714 | 9/1923 | Doerr | 473/330 |
| 1,525,137 | 2/1925 | Lawton | 473/330 |
| 2,665,909 | 1/1954 | Wilson | 473/330 |
| 3,975,023 | 8/1976 | Inamori | 473/342 |
| 3,989,257 | 11/1976 | Barr | 473/330 |
| 4,077,633 | 3/1978 | Studen | 473/330 |
| 4,162,074 | 7/1979 | Thomson | 473/330 |
| 4,749,197 | 6/1988 | Orlowski | 473/342 |
| 4,768,787 | 9/1988 | Shira | 473/331 |
| 4,795,158 | 1/1989 | Kuykendall | 473/340 |
| 5,029,865 | 7/1991 | Kim | 473/330 |
| 5,303,923 | 4/1994 | Garcia | 473/330 |
| 5,348,301 | 9/1994 | Ma | 473/331 |
| 5,354,060 | 10/1994 | Wooten | 473/330 |

FOREIGN PATENT DOCUMENTS

| | | | |
|---|---|---|---|
| 1205098 | 5/1986 | Canada | 273/167 B |
| 27807 | of 1911 | United Kingdom | 273/175 |

*Primary Examiner*—Sebastiano Passaniti
*Attorney, Agent, or Firm*—Graham & James LLP

[57] ABSTRACT

A golf putter head having a continuous face comprised of a curved section leading into a hemi-toroid section with an increasingly flattened surface progressively leading into a negative angle of from about 2° to 10° from a vertical face. The head is configured to present the curved section relative to a golf ball when the head is positioned below an equator of the ball, and to present a flattened surface at each angle that the putter head contacts the ball. Accidental hop is prevented and the ball is struck true at every incident point of contact between the putter head and the ball.

7 Claims, 6 Drawing Sheets

GOLF PUTTER HEAD PUTTING DEVICE

FIELD OF THE INVENTION

This invention relates to golf club putter heads and the putting faces thereof and particularly to such heads which present a curved surface face to a golf ball during putting.

BACKGROUND OF THE INVENTION

Golf club putters having curved putting surfaces provide advantages in enabling truer rolls because of the over spin which they are able to impart to a ball during putting and particularly when made of a material such as titanium. The over spin causes the ball to hug the putting surface, without the skips or hops which may affect the accuracy of the putt. However, in order to maintain such advantage it is necessary for the putter head to be aligned with and actually strike the ball at a position on the ball below the equator of the ball. Should the curved surface contact the ball at a position above the equator and particularly when a degree of force is required, such as with a long putt, this contact of curved surface with the ball will actually force the ball into the ground, with a nearly inevitable, difficult to control, hop, which is detrimental to putting accuracy. The excessively high contact is very likely to occur with power putts because of the longer swing and the tendency of the golfer to try to avoid clipping the ground which may skew the putter head during the swing.

Even with putters having flat faces, the angle of contact, whether late or early in the swing, presents an angled rather than a flat contact surface, and if not actually intended or controlled, can result in unwanted lift or hop. Thus it is be desirable for players having problems with their swing to utilize putters with varying angled flat faces which compensate for early or late contact during the swing to provide a desired full flat surface contact (or angled lift contact). A slight lift is however desirable in order to slightly lift a ball from a nestle within grass in a ground surface. Accordingly, standard flat faced putters are made with a 3° positive angled flat surface. This however exacerbates problems with late or early contact with varying angle contacts and significant inconsistencies inherent therein. A ball may be driven into the ground with an early strike and lofted off the ground with a later strike. Radial surface putters avoid this problem by providing an effective degree of loft when the ball is struck below the equator with the same effective loft being maintained through a wide range of effective putting strokes.

Another common problem in putting which provides the same effect as early or late stiking contact is that of the hand position of the golfer in relation to the club head at the time of impact. Thus, if the hands are brought through too early in relation to the putter head the result is the same as if impact was made early in the stroke where the club is tilted forward. A radial face allows or compensates for early or hands forward but a flat face does not. Breaking of the wrists resulting in the head of the golf club being in front of the hands at impace provides the same result as a late strike in the stroke. This is detrimental with use of either a flat or radius face putter of the prior art.

However, golf clubs, made according to accepted tournament playing rules and which are not of a novelty type, are not permitted to have different faces for hitting a ball and different clubs must be utilized by a golfer having swing and ball contact variations.

SUMMARY OF THE INVENTION

It is therefore an object of the present invention to provide a golf club putter with a tournament legal variable face which presents a curved face to a golf ball when the ball is struck below its equator and a substantially flat surface (relative to the golf ball), regardless of the angle at which the putter head contacts the ball.

Generally the present invention comprises a golf putter head having a continuous striking face along a longitudinal axis thereof, located parallel to the ground, when in a putting position. The striking face comprises an upper, relative to the ground, laterally extending radial section, which extends along a length of the putter head. The radial section leads downwardly into an increasingly flattened surface section (toroidal or hemi-toroidal configuration) forming a negative angle of from about 2° to 15°, relative to a surface plane, normal to the ground and located between a golf ball and the putter head, when directly aligned with the golf ball. With such structure the putter head is configured to present either of the radial section, or flattened surface section of the striking face for contact with the golf ball at a position no higher than an equator of the ball, at any portion of a putting swing (i.e., early and late parts of the swing and even with a slightly elevated striking contact, relative to the ground). Accidental hop (resulting from above equator striking) is prevented and the ball is struck true at every incident point of contact between the putter head and the ball.

The above objects, features and advantages of the putter head of the present invention will become more evident from the following discussion and drawings in which:

SHORT DESCRIPTION OF THE DRAWINGS

FIGS. 1*a–c* are schematic side views showing contact of a flat face putter surface of a prior art putter (3° lofted putter), with a ball, at different points of a swing and at different height levels of the ball.

FIGS. 2*a–c* are similar schematic side views show in contact of a cylindrical or round faced putter surface of a prior art putter, at different points of a swing and at different height levels of the ball.

Figure 4:
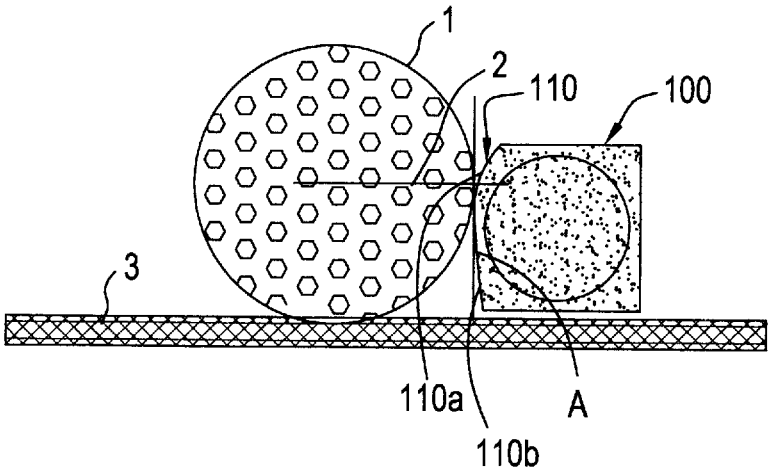
FIG. 4 is a schematic side view of the putting surface of the golf club putter head of the present invention, shown adjacently aligned with a golf ball.
Figure 6A:
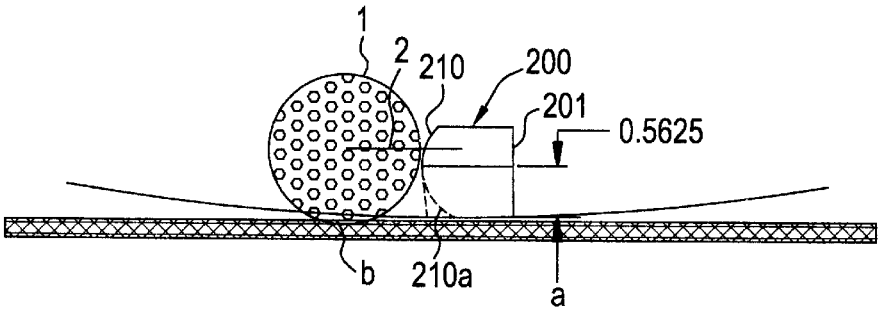
Figure 6B:
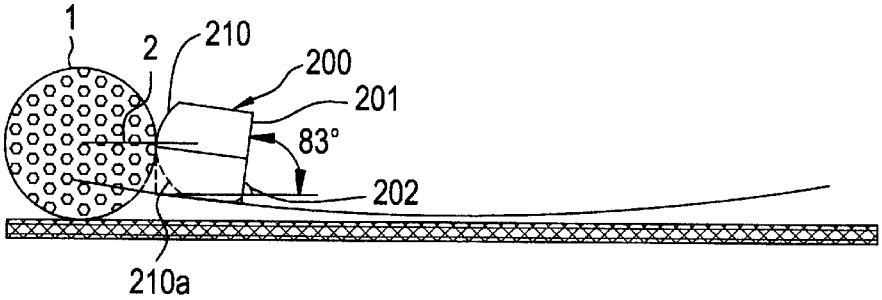
Figure 7A:
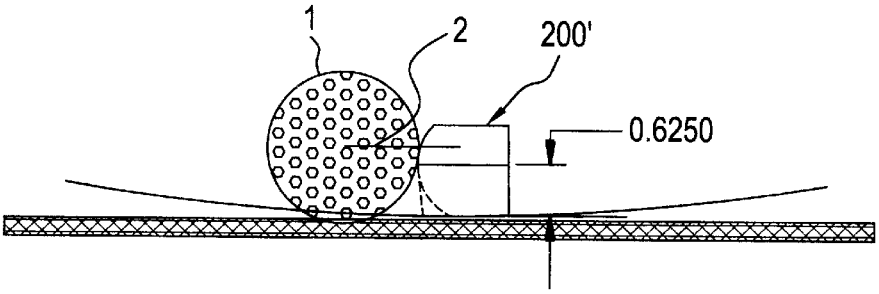
Figure 7B:
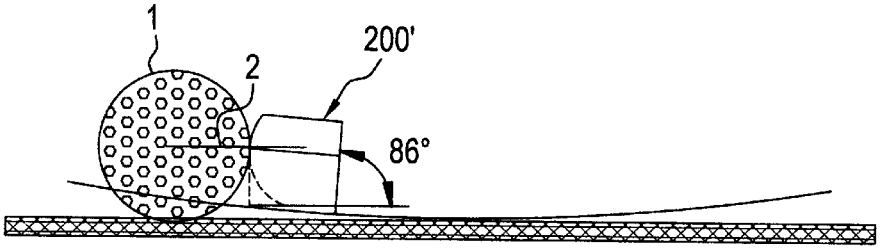

FIGS. 5*a–e* are schematic side view depicting various points of contact of the putting surface of the golf club of FIG. 4 with a golf ball, at sequential different stages of a swing and at sequentially higher elevations of the putter from the ground;

FIGS. 6*a–b* depict determination of the negative angle for the flat surface portion of the putter face for a face having a first height dimension; and FIGS. 7*a–b* depict a similar determination for a face having a second height dimension.

DETAILED DESCRIPTION OF THE INVENTION

The golf club putter of the present invention embodies an elongated regular and balanced configuration of any common putter type but with modification of the actual surface which contacts the ball during putting. Prior art putting faces fall into two general categories:

a) the standard flat face, which either presents a parallel face when adjacently aligned with the ball or with a predetermined tilt (generally with an upward slope to provide a lift, if desired); and b) a curved or cylindrical face surface which presents a minimal point of contact surface with a ball and with which it is highly desirable that contact be effected at or below the ball equator to avoid uncontrollable hop (such putters have a cross diameter less than that of the golf ball in order to provide such below equator contact).

With either of such putters, control must be exercised to ensure contact with the ball at an optimal portion of the swing and at an elevation which provides the optimal contact with a specific section of the ball. Thus, with flat faced putters, unless contact is square, unwanted loft or hop may result. The unwanted hop is even more prevalent with round face putters which strike the upper half of a golf ball during putting. In order to compensate for such unwanted results, golfers will, according to their personal swing characteristic (especially if variable), use putters with different angled flat faces. Excessive height lifting of the putter head is however usually not readily compensated for, especially when the golfer is using a radial face putter.

In accordance with the present invention, a unique continuously variable golf putter striking face, which is tournament legal, is provided which is self adjusting to compensate for early, late and elevated swings. The face of the golf putting head comprises a rounded or radial upper surface portion which is increasingly flattened (with an increasingly greater radius of curvature) towards the base of the putting head nearest the ground. There are no separately defined areas of curvature and flats (i.e. the putter face is not two-faced as prohibited by accepted tournament playing rules). Instead there is a single hemi-toroidal head with a changing curve similar to that of a french curve, with an increasingly greater radius of curvature, asymptotically approaching a fully flat surface. The portion of the flattening surface at the base of the putter head presents an angle of from about 2° to 15° and preferably from 2° to 10° relative to the normal contact plane with the ball when directly adjacently aligned therewith. As a result, square contact with the ball equator is effected by the putter surface at substantially all points of contact (including early and late contact) in a normal putting swing and at normal variations of putter elevation. It is noted that swings requiring excessive extension and with excessive elevation to effect contact (close to actual missing the ball) have improved though not ideal contact with the putter of the present invention.

In determining the appropriate negative angle for a putter face of particular size, the diameter of a standard golf ball (0.84" radius) is aligned with an arced or rounded putter face. Initially, the height of the forwardmost part of the curve of the putter face from the ground (when the putter face is directly aligned with the golf ball) cannot exceed the golf ball radius since it would contact the ball above the center line, tending to drive it into the ground. With a putter having a curved face of appropriate dimension, the non-contacting flat rear surface of the putter is made perpendicular to the ground and parallel to the tangent of the center line of the golf ball. The round face of the putter is then contacted with the ball at its center-line midpoint, at a late portion of a swing. The angular deviation of the rear surface from the perpendicular is optimal for the negative angle for the flattened surface portion of the putter face. If the arc is not that of a section of a cylinder, arc radius or specific radial configuration should be accounted for.

Allowance, in all instances should be made for the clearance of the putter head above the ground and for the ball to be seated below the surface of the green, in determining relative relationships and dimensions.

It is currently the practice to utilize soft polymers (usually as striking face inserts) or soft metals in flat face golf putters in order to keep the ball on the face longer. However, such materials are disadvantageous for use with putters having radial or curved faces such as those of the present invention, since increased time of the ball remaining in contact with a radial face may cause the ball to be detrimentally lofted off a green. Accordingly, for the putters of the present invention as well as for radial face putters, in general, it is preferred that the putter face be comprised of a material or a coating on an underlying substrate which provides a fast ball reaction off the face. Examples of such materials preferred for the putter face of the present invention include metals, such as titanium, and titanium alloys, as well as ceramics and hard polymers. Examples of suitable coatings include titanium nitride, ceramics, anodized hard coats and diamond coatings. Suitable methods for applying the coats or coatings include chemical or physical vapor depositions with ion impregnation; and chemical grafting by which monomers are covalently bonded to a substrate.

DETAILED DESCRIPTION OF THE DRAWINGS AND THE PREFERRED EMBODIMENT

Figure 1A:
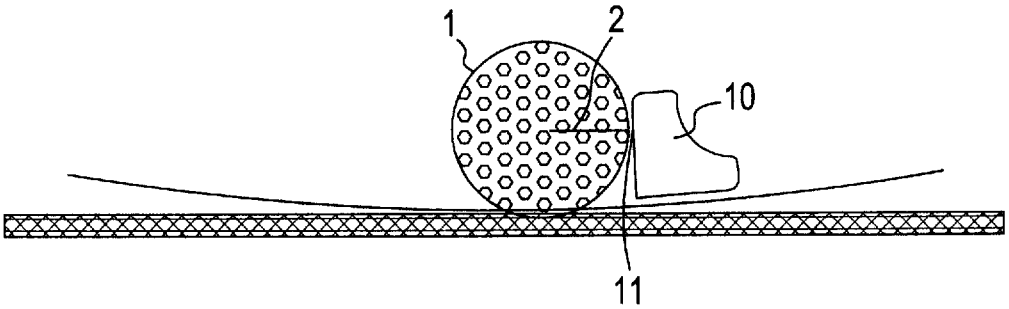
FIG.1A PRIOR ART
Figure 1B:
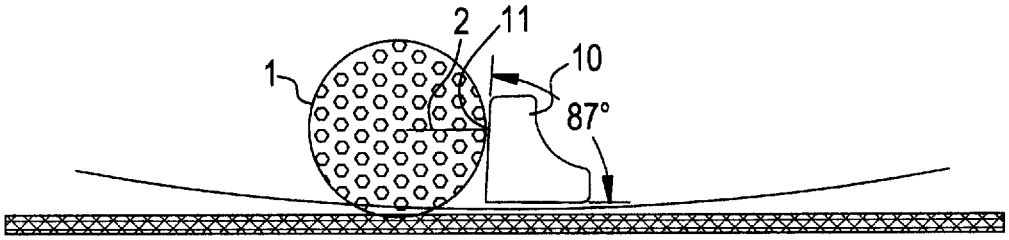
FIG.1B PRIOR ART
Figure 1C:
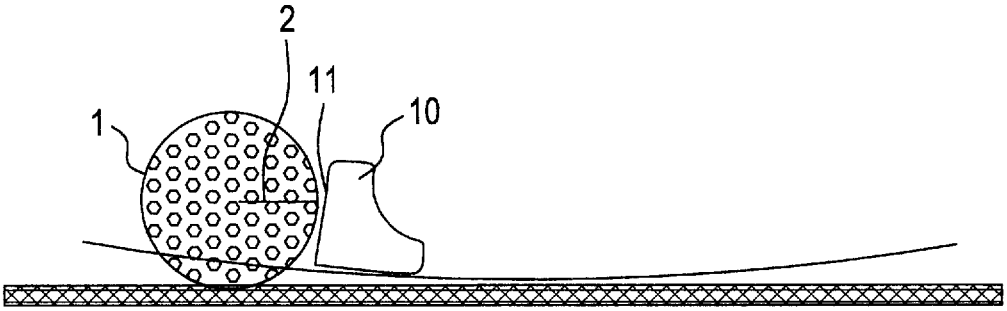
FIG.1C PRIOR ART
Figure 2A:
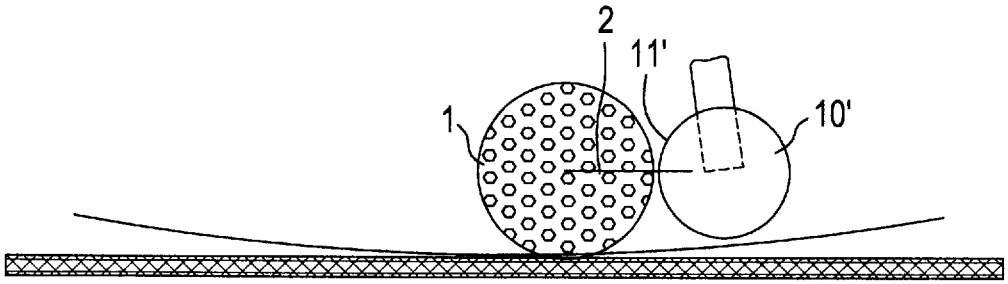
FIG.2A PRIOR ART
Figure 2B:
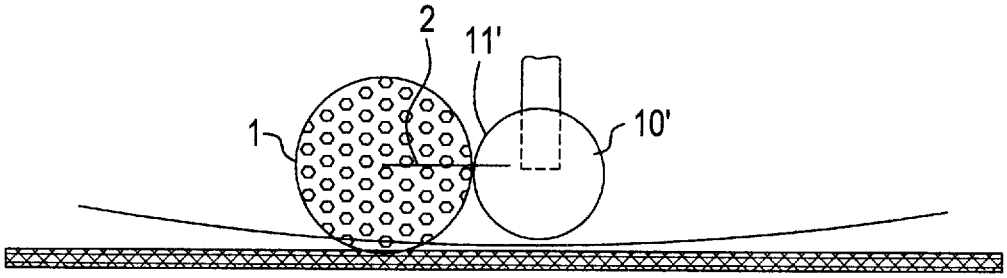
FIG.2B PRIOR ART
Figure 2C:
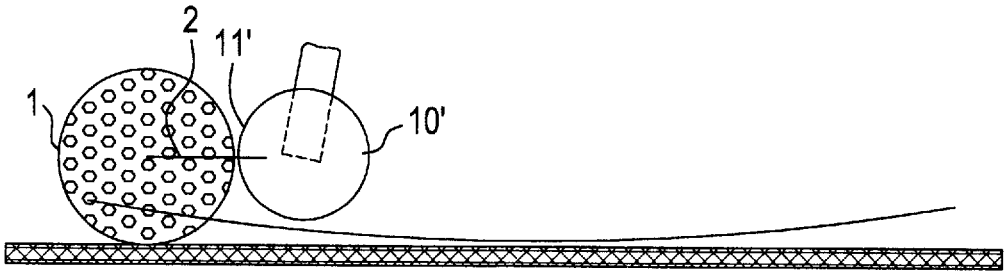
FIG.2C PRIOR ART

With reference to the drawings, in FIGS. 1*a–c*, and 2*a–c*, prior art putters 10 and 10' of flat face 11 (lofted type with standard 3° positive offset) and round face 11' surface configurations respectively, are shown contacting golf ball 1 at different points relative to the equator 2 of the golf ball. Properly effected putts (with straight roll) are made with contact as shown in FIGS. 1*b* (flat surface at or slightly below equator) and 2*a* and 2*b* (radial surface at and below equator) serve to provide a slight loft to lift a ball out of a nestle in ground grass. However, deviations in swing such as shown in FIGS. 1*c* and 2*c* with a late hit (flat and radial surface contact above the equator) may cause a much higher degree of loft than desired (FIG. 1*c*) or an uncontrolled hop (FIG. 2*c*). Contact as shown at 1*a* (flat contact surface below equator) provides a lift (either by contact late in the swing or with an initially tilted face), which may not be desired. Impact early in the stroke with the lofted face can drive the ball slightly into the ground resulting in skidding or hopping.

Figure 3:
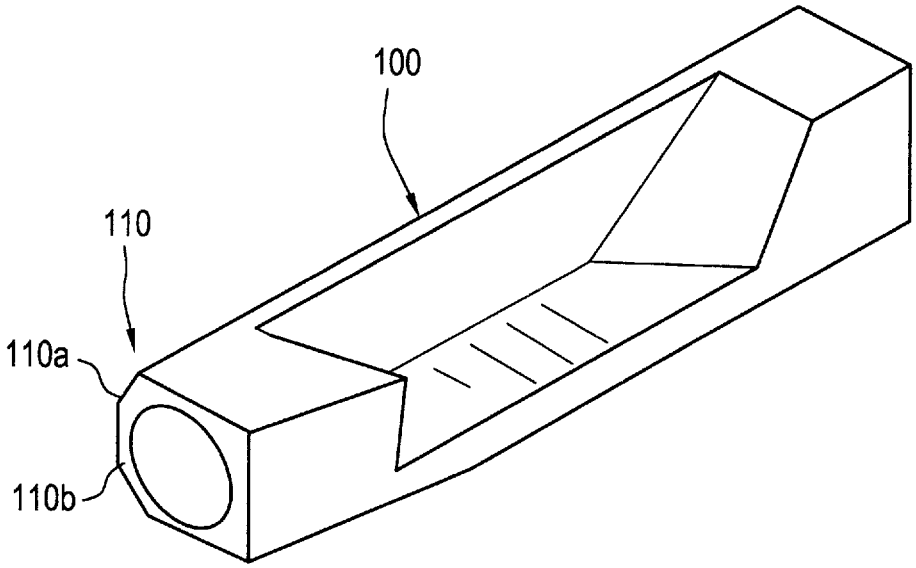
FIG. 3 is an isometric rear view of a golf club putter head of the present invention.

In accordance with the present invention, the putter 100 shown in FIG. 3 and 4, provides a varying surface 110 which presents a square striking contact (with imparted over spin) below the equator 2 of golf ball 1, when contact is with the curved surface portion 110*a*. Contact is no higher than the equator even with early and late contact during the swing and even with elevation of the putter head. Square contact is effected with an essentially flat face portion 110*b* during such swing variations. As shown in FIG. 4, surface 110*b*, when adjacently aligned with a golf ball 1, provides a negative angle A of about 7° with a hemi-toroid configuration. This configuration embodies an upper portion 110*a*, relative to ground 3, of smaller radius of curvature and a lower, flattened larger radius of curvature, whereby the desired variations in striking surface contact is provided.

Figure 5A:
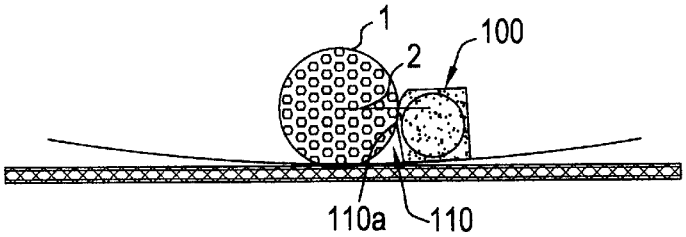
Figure 5B:
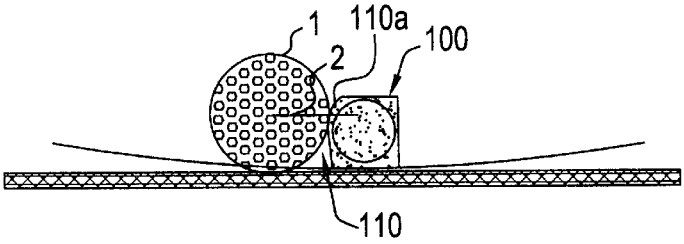
Figure 5C:
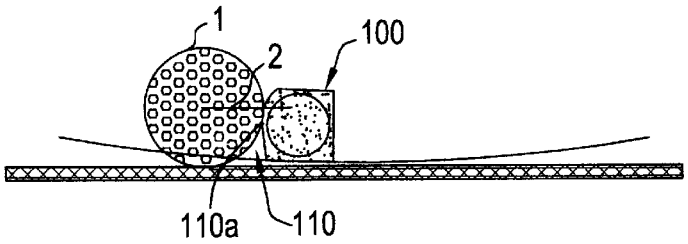
Figure 5D:
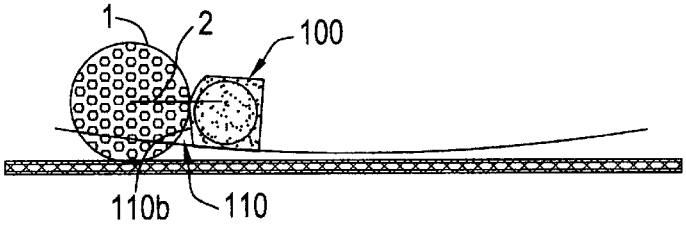
Figure 5E:
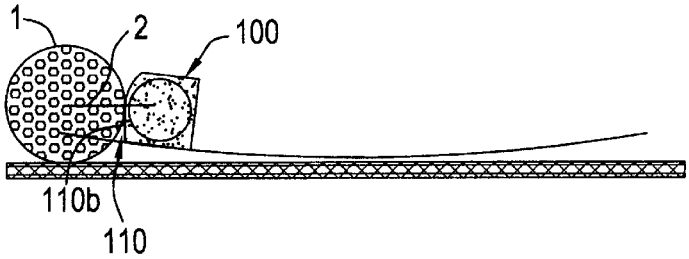

Striking sequences shown in FIGS. 5*a–e* illustrate the effect of increasingly higher striking contact between face 110 and ball 1, as well as contact at different points of a putting swing. As shown in all such Figures, all portions of face 110 extend away from contact with the golf ball, except for the appropriate shape and position to effect a square contact at or below the equator of the ball, at all points of the swing and even at elevated putter head heights. FIG. 5*b* illustrates the ideal square striking of face 110 with golf ball 1 with curved section 110*a* below equator 2. FIG. 5*a* shows early contact with curved section 110*a* below equator 2. FIG. 5*c* shows somewhat late contact and elevation but still with curved section 110*a* below equator 2. FIGS. 5*d* and 5*e* illustrate increasing late contact and elevation but with flat section 110*b* at equator 2.

As shown in FIG. 6*a,* putter 200 with arced face 210, is shown with a point of contact 0.5625" above the base of the putter (shown elevated slightly by distance "a" for clearance) with golf ball 1 (shown nested slightly into the green by distance "b"). As aligned in FIG. 6*a,* flat rear surface 201 is perpendicular to the ground. In a late part of the swing shown in FIG. 6*b,* where the curve of arced face 210 contact the equator midpoint 2 of the golf ball, the angle 202 of rear face 201 is measured, and as shown is 83° with the deviation being 7°. This deviation is the optimal negative angle from perpendicularity at which portion 210*a* (shown in dotted lines) is flattened.

In FIGS. 7*a* and 7*b* a putter 200' with a point of contact of 0.6250 above the base of the putter is similarly measured with respect to golf ball 1 and the angle of deviation is 4° as the optimal negative angle. Higher putter faces will have decreasingly less deviation as described.

It is understood that the above discussion and details of the preferred embodiment and drawings are exemplary of the present invention and that changes in structure and configuration of golf putters as well as materials for the construction thereof may be effected without departing from the scope of the present invention as defined in the following claims.

What is claimed is:

1. A golf putter head having a continuous striking face along a longitudinal axis thereof, located parallel to the ground, when in a putting position; with the striking face comprising an upper, relative to the ground, laterally extending radial section, which uniformly extends along a length of the putter head, with said radial section, beginning at the upper end of the striking face and providing a substantially curved striking face throughout the height of the radial section, with the curvature of the curved striking face in the radial section remaining constant or gradually decreasing from the upper end of the striking face and downwardly, with the radial section leading into an increasingly flattened surface section forming a negative angle, relative to a surface plane, normal to the ground and located between a golf ball and the putter head, when directly aligned with the golf ball; wherein the putter head is configured to present either of the radial section, or flattened surface section of the striking face for contact with the golf ball at a position no higher than an equator of the ball, at any portion of an effective putting swing.

2. The golf putter head of claim 1, wherein the negative angle ranges from about 2° to 15°.

3. The golf putter head of claim 2, wherein the radial section of the putting face is an arc section of a cylinder.

4. The golf putter head of claim 2, wherein the radial section of the putting face does not define an arc section of a cylinder.

5. The golf putter head of claim 2, wherein the putting face is comprised of titanium or titanium alloy.

6. The golf putter head of claim 2, wherein the putting face is comprised of a material selected from the group consisting of ceramics and hard polymers.

7. The golf putter head of claim 2, wherein the putting face is comprised of a coating on a substrate with the coating material being selected from the group consisting of titanium nitride, ceramics, anodized hard metal and diamond.

* * * * *